US008778579B2

(12) United States Patent
Kim

(10) Patent No.: US 8,778,579 B2
(45) Date of Patent: Jul. 15, 2014

(54) ELECTROPHOTOGRAPHIC PHOTORECEPTOR HAVING EXCELLENT LIFETIME CHARACTERISTICS AND CHARGE UNIFORMITY, AND ELECTROPHOTOGRAPHIC IMAGE FORMING APPARATUS AND ELECTROPHOTOGRAPHIC CARTRIDGE USING THE ELECTROPHOTOGRAPHIC PHOTO RECEPTOR

(75) Inventor: Ji-uk Kim, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 57 days.

(21) Appl. No.: 13/589,464

(22) Filed: Aug. 20, 2012

(65) Prior Publication Data

US 2013/0157180 A1 Jun. 20, 2013

(30) Foreign Application Priority Data

Dec. 14, 2011 (KR) ..... 10-2011-0134460

(51) Int. Cl.
*G03G 5/00* (2006.01)

(52) U.S. Cl.
USPC ..... 430/56; 430/59.4; 430/60; 399/159

(58) Field of Classification Search
USPC ..... 430/56, 59.4, 60; 399/159
See application file for complete search history.

(56) References Cited

U.S. PATENT DOCUMENTS 6,205,307 B1 * 3/2001 Nukada et al. ..... 399/152
2009/0202929 A1 * 8/2009 Kim et al. ..... 430/58.25

FOREIGN PATENT DOCUMENTS

JP 1-142658 6/1989
JP 1-221461 9/1989
JP 2001-312082 11/2001

OTHER PUBLICATIONS

Frank H. Moser et al., "Phthalocyanine Compounds", 1963, pp. 1-365.

* cited by examiner

*Primary Examiner* — Mark A Chapman
(74) *Attorney, Agent, or Firm* — Staas & Halsey LLP

(57) ABSTRACT

Provided is a laminate type electrophotographic photoreceptor including an electrically conductive substrate, and an undercoat layer, a charge generation layer, and a charge transport layer sequentially disposed on the electrically conductive substrate, in which a characteristic response time of the photoreceptor is about 10 msec or more and about 85 msec or less and a thickness of the charge transport layer is greater than about 18 μm and equal to or less than about 45 μm. Also, an electrophotographic image forming apparatus and an electrophotographic cartridge using the electrophotographic photoreceptor are provided. An electrophotographic photoreceptor according to the present general inventive concept has an improved response time and thus, charge stain characteristics are excellent even when a thick charge transport layer is selected. Therefore, the electrophotographic photoreceptor of the present general inventive concept may have both excellent lifetime characteristics and excellent charge stain characteristics.

17 Claims, 6 Drawing Sheets

ELECTROPHOTOGRAPHIC PHOTORECEPTOR HAVING EXCELLENT LIFETIME CHARACTERISTICS AND CHARGE UNIFORMITY, AND ELECTROPHOTOGRAPHIC IMAGE FORMING APPARATUS AND ELECTROPHOTOGRAPHIC CARTRIDGE USING THE ELECTROPHOTOGRAPHIC PHOTO RECEPTOR

CROSS-REFERENCE TO RELATED APPLICATIONS

This application claims the benefit of Korean Patent Application No. 10-2011-0134460, filed on Dec. 14, 2011, in the Korean Intellectual Property Office, the disclosure of which is incorporated herein in its entirety by reference.

BACKGROUND

1. Field

The present disclosure relates to an electrophotographic photoreceptor used in the fields of copy machines, printers, or facsimile machines, etc, and an electrophotographic image forming apparatus and an electrophotographic cartridge using the electrophotographic photoreceptor.

2. Description of the Related Art

Electrophotographic devices such as facsimile machines, laser printers, copying machines, cathode ray tube (CRT) printers, liquid crystal printers, light-emitting diode (LED) printers, large plotters and laser electrophotographs and the like include an electrophotographic photoreceptor comprising a photosensitive layer formed on an electrically conductive substrate. The electrophotographic photoreceptor can be in the form of a plate, a disk, a sheet, a belt, a drum, or the like and forms an image as follows. First, a surface of the photosensitive layer is uniformly and electrostatically charged, and then the charged surface is exposed to a pattern of light, thus forming an image. The light exposure selectively dissipates the charge in the exposed regions where the light strikes the surface, thereby forming a pattern of charged and uncharged regions, which is referred to as a latent image. Then, a wet or dry toner is provided in the vicinity of the latent image, and toner droplets or particles collect in either the charged or uncharged regions to form a toner image on the surface of the photosensitive layer. The resulting toner image may be transferred to a suitable final or intermediate receiving surface, such as paper, or the photosensitive layer may function as the final receptor for receiving the image. Lastly, a residual electrostatic image on the surface of the photosensitive layer is removed by radiating light, emitted from an eraser lamp, on the surface of the photosensitive layer uniformly. Then, a small amount of residual toner left on the surface of the photosensitive layer is removed by using mechanical means such as a brush or blade.

A contact charging method is used as a charging method of an electrophotographic photoreceptor, instead of using a corona charging method. The contact charging method charges a surface of an electrophotographic photoreceptor to a predetermined electric potential by contacting the surface of the electrophotographic photoreceptor with a charging member such as an electrically conductive elastic roller in which direct voltages of about 1 KV to about 2 KV are applied from the outside.

The contact charging method may be classified into a direct current (DC) contact charging method, in which only a direct voltage is applied, and an alternating current (AC)/direct current (DC) contact charging method in which an alternating voltage is applied in superposition of a direct voltage. The DC contact charging method is advantageous in terms of increasing the lifetime of a developer, but is disadvantageous in that charge stains caused by non-uniform charging and discharge dielectric breakdown of an electrophotographic photoreceptor caused by direct application of a voltage may easily occur. Therefore, the AC/DC contact charging method is used mostly. However, a contact charging method, either a DC contact charging method or an AC/DC contact charging method, has limitations in that durability of a photoreceptor may decrease, for instance, a wear amount of a photoreceptor surface layer may increase. Therefore, with respect to a laminate type organic electrophotographic photoreceptor having a double-layer structured photosensitive layer including a charge generation layer (CGL) and a charge transport layer (CTL), the lifetime thereof is secured by using a method of increasing a thickness of the CTL. However, when the thickness of the CTL is increased, charge non-uniformity may be facilitated because charge capacity decreases and residual electric potential increases. When the charge non-uniformity occurs, reproducibility of an electrostatic latent image decreases and charge stains increase, and thus, high image quality and long lifetime may be hard to be compatible.

Therefore, in order to avoid charge stains in a laminate type electrophotographic photoreceptor, a method of removing charge stains is mainly selected, in which an electrostatic capacity is maximized by minimizing the thickness of a CTL in a range of about 9 μm to about 18 μm. For example, Japanese Patent Application Laid-Open Publication No. 2001-312082 aimed to obtain both high image quality and long lifetime by choosing a method of having a CTL thickness of about 9 μm to about 18 μm and also increasing an electrostatic capacity C for 1 $cm^2$ of an electrophotographic photoreceptor to about 130 pF or more. However, when the thickness of the CTL is formed to be about 18 μm or less, the lifetime of the electrophotographic photoreceptor may be shortened.

SUMMARY

Additional aspects and/or advantages will be set forth in part in the description which follows and, in part, will be apparent from the description, or may be learned by practice of the invention.

The present disclosure provides an electrophotographic photoreceptor having excellent lifetime characteristics due to a thick charge transport layer of a laminate type electrophotographic photoreceptor as well as excellent charge stain characteristics.

The present disclosure also provides an electrophotographic image forming apparatus using the electrophotographic photoreceptor.

The present disclosure also provides an electrophotographic cartridge using the electrophotographic photoreceptor.

According to an aspect of the present disclosure, there is provided a laminate type electrophotographic photoreceptor including: an electrically conductive substrate; and an undercoat layer (UL), a charge generation layer (CGL), and a charge transport layer (CTL) sequentially disposed on the electrically conductive substrate. A characteristic response time of the photoreceptor is about 10 msec or more and about 85 msec or less and a thickness of the charge transport layer is greater than about 18 μm and equal to or less than about 45

μm. Wherein the characteristic response time is denoted as a shortest response time in a range of response times generating characteristic photoinduced discharge curves (PIDC), the response time is denoted as a time elapsed from the moment of light exposure of the laminate type electrophotographic photoreceptor to the moment of development thereof. The characteristic PIDC is denoted, in a photoinduced discharge characteristic test in which the laminate type electrophotographic photoreceptor is charged to have an initial surface potential range of about −500 V to about −700 V by using a direct current (DC) contact charging method in an environment of a temperature of 23° C. and a relative humidity of 50% and, thereafter, the laminate type electrophotographic photoreceptor is exposed to monochromatic light having a wavelength of about 780 nm, as a PIDC exhibiting a saturation phenomenon in which the surface potential of the laminate type electrophotographic photoreceptor after the light exposure is in a range of about 0 V to about −200 V and the surface potential of the laminate type electrophotographic photoreceptor after the light exposure does not change about ±10 V or more even when exposure energy increases 10 times.

The CGL may include a charge generating material and a binder resin, and a weight ratio of the charge generating material to the binder resin may be in a range of about 1:0.3 to about 1:4.

The CTL may include a charge transporting material and a binder resin, and a weight ratio of the charge transporting material to the binder resin may be in a range of about 1:0.5 to about 1:2.

The UL may be a layer in which metal oxide particles are dispersed in a binder resin or a metal oxide film.

The photoreceptor may be a laminated type photoreceptor charged by a direct charging method.

According to another aspect, there is provided an electrophotographic image forming apparatus including: the electrophotographic photoreceptor according to an aspect; a charging device charging the electrophotographic photoreceptor in contact with the electrophotographic photoreceptor; an exposure device forming an electrostatic latent image on a surface of the electrophotographic photoreceptor; a developing device developing the electrostatic latent image to form a visible image; a transferring device transferring the visible image on an image receiving member; and a cleaning device cleaning the surface of the electrophotographic photoreceptor after the transferring.

The charging device may apply only a direct voltage to the electrophotographic photoreceptor.

The charging device may be a charging roller.

According to another aspect, there is provided an electrophotographic cartridge integrally supporting the electrophotographic photoreceptor according to an aspect of the present general inventive concept; and at least one device selected from the group consisting of a charging device charging the electrophotographic photoreceptor in contact with the electrophotographic photoreceptor, a developing device developing an electrostatic latent image formed on the electrophotographic photoreceptor to form a visible image, a transferring device transferring the visible image on an image receiving member and a cleaning device cleaning a surface of the electrophotographic photoreceptor after transferring, and attachable to an electrophotographic image forming apparatus and detachable from the electrophotographic image forming apparatus.

The characteristic response time of the photoreceptor may be about 20 msec or more and about 75 msec or less and the thickness of the charge transport layer of the photoreceptor may be about 20 μm or more and about 36 μm or less.

BRIEF DESCRIPTION OF THE DRAWINGS

The above and other features and advantages of the present general inventive concept will become more apparent by describing in detail exemplary embodiments thereof with reference to the attached drawings in which.

DETAILED DESCRIPTION

Figure 1:
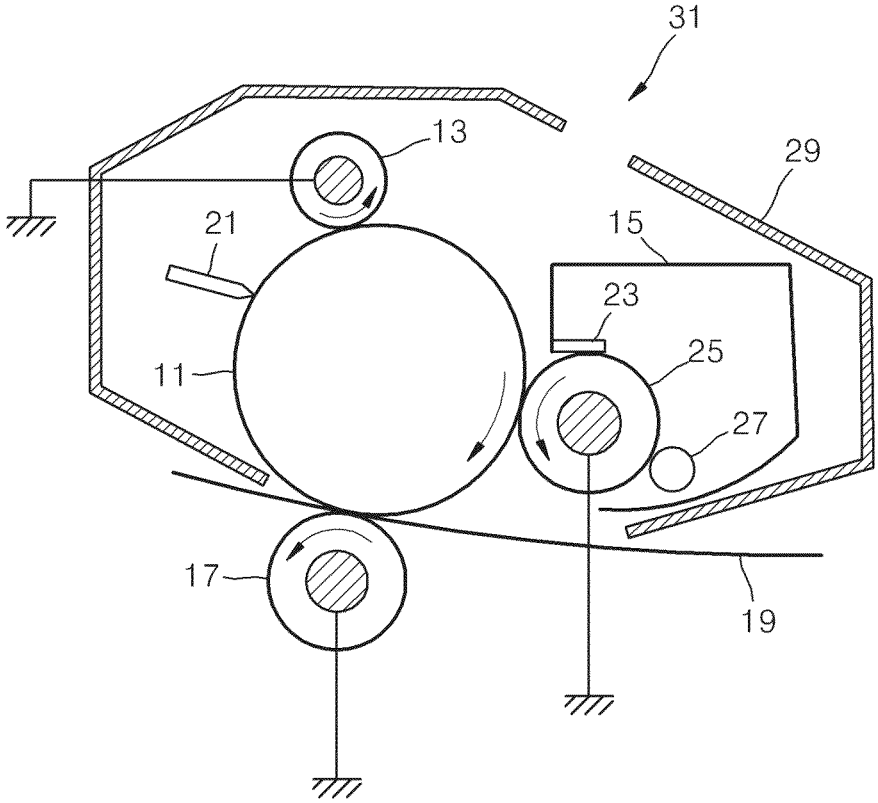
FIG. 1 is a schematic view illustrating an embodiment of an electrophotographic image forming apparatus and an electrophotographic cartridge including an electrophotographic photoreceptor according to an embodiment of the present general inventive concept.

The present disclosure will now be described more fully with reference to the accompanying drawings, in which exemplary embodiments of the present disclosure are shown.

Hereinafter, an electrophotographic photoreceptor according to an embodiment of the present disclosure, and an electrophotographic image forming apparatus and an electrophotographic cartridge using the electrophotographic photoreceptor are described in detail. A negatively charged laminate type electrophotographic photoreceptor is described below, but the present disclosure is not limited thereto.

The laminate type electrophotographic photoreceptor of the present disclosure has a structure in which an undercoat layer, a charge generating layer and a charge transporting layer are sequentially formed on an electrically conductive substrate wherein the charge generating layer and the charge transporting layer together constitute a photosensitive layer.

The electrically conductive substrate may be in the form of a drum, pipe, belt, plate or the like which may comprise any conductive material, for example, a metal, or an electrically conductive polymer, or the like. The metal may be aluminium, vanadium, nickel, copper, zinc, palladium, indium, tin, platinum, stainless steel, chrome, or the like. The electrically conductive polymer may be a polyester resin, polycarbonate resin, a polyamide resin, a polyimide resin, mixtures thereof, or a copolymer of monomers used in preparing the resins described above in which an electrically conductive material such as a conductive carbon, tin oxide, indium oxide, or the like is dispersed. An organic polymer sheet on which a metal is deposited or a metal sheet is laminated may be used as the electrically conductive substrate.

The undercoat layer is formed between the electrically conductive substrate and the charge generation layer, as described below. The undercoat layer as allows for the improvement of image quality through preventing charge injection to the photosensitive layer from the electrically conductive substrate. The undercoat layer further allows for the improvement of adhesion between the electrically conductive substrate and a photosensitive layer, and prevention of dielectric breakdown of the photosensitive layer. The undercoat layer may be formed by dispersing a conductive powder such as carbon black, graphite, metal powder, or a metal oxide powder such as indium oxide, tin oxide, indium tin oxide, or titanium oxide in an insulating binder resin such as a polyamide, a polyimide, polyvinyl alcohol, casein, ethylcellulose, gelatin, a phenolic resin, a melamine resin, or the like; or a conductive binder resin such as a polythiophene, a polypyrrole, and a polyaniline. The undercoat layer may also be formed of an inorganic layer, for example, anodic aluminium oxide, aluminium oxide, and aluminium hydroxide.

A decrease in the electrical resistance of the laminate type electrophotographic photoreceptor by adding metal oxide particles in the undercoat layer may help to reduce charge stains. However, this may decrease the lifetime of the laminate type electrophotographic photoreceptor and also, a charge leakage may occur in a high-temperature, high-humidity (HT-HH) environment. Therefore, an added amount of the metal oxide particles is determined in consideration of the foregoing two aspects. A thickness of the undercoat layer may be in a range of about 0.05 μm to about 50 μm, for example, about 0.05 μm to about 5 μm, specifically about 0.3 μm to about 1 μm.

The charge generation layer and the charge transport layer are sequentially formed as a photosensitive layer on the undercoat layer.

The charge generation layer has a configuration in which a charge generating material is dispersed and/or dissolved in a binder resin.

Particular examples of usable charge generating material may be organic materials, such as a phthalocyanine-based compound, an azo-based compound, a bisazo-based compound, a triazo-based compound, a quinone-based pigment, a perylene-based compound, an indigo-based compound, a bisbenzoimidazole-based pigment, an anthraquinone-based compound, a quinacridone-based compound, an azulenium-based compound, a squarylium-based compound, a pyrylium-based compound, a triarylmethane-based compound, a cyanine-based compound, a perynone-based compound, a polycycloquinone-based compound, a pyrrolopyrrole-based compound, or a naphthalocyanine-based compound, and inorganic materials, such as amorphous silicon, amorphous selenium, rhombohedral selenium, tellurium, a selenium-tellurium alloy, cadmium sulfide, antimony sulfide, or zinc sulfide. However, the charge generating material that may be used in the photosensitive layer is not limited thereto, and the charge generating materials may be used alone or in combination of two or more thereof. The charge generating material in the present general inventive concept is particularly a phthalocyanine-based compound. The phthalocyanine-based compound is not particularly limited so long as it satisfies Chemical Formula 1 or 2. The phthalocyanine-based compound may be a metal-free phthalocyanine-based compound represented by the following Chemical Formula 1, a metal phthalocyanine-based compound represented by the following Chemical Formula 2, or a mixture thereof.

[Chemical Formula 1]

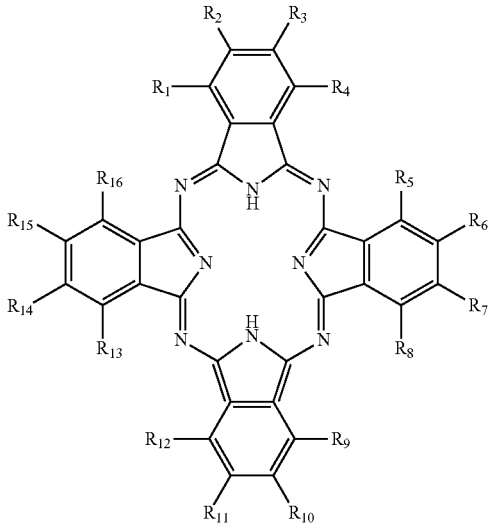

[Chemical Formula 2]

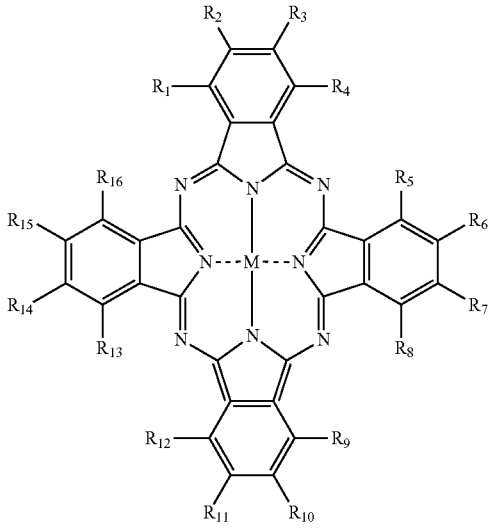

where $R_1$ to $R_{16}$ each independently represent a hydrogen atom, a halogen atom, a nitro group, an alkyl group with a carbon number of about 1 to 20, for example, a carbon number of about 1 to 7, or an alkoxy group with a carbon number of about 1 to 20, for example, a carbon number of about 1 to 7, and M is Cu, Fe, Mg, Sn, Pb, Zn, Co, Ni, Mo, or halogenated aluminum; or Ti, V, Zr, Ge, Ga, Sn, Si or In with an oxygen atom, halogen atom, or hydroxy group bonded thereto. The alkyl group or alkoxy group may be substituted with an appropriate substituent. Particular examples of the phthalocyanine-based compound may be a metal-free phthalocyanine, titanyl phthalocyanine, oxo-titanyl phthalocyanine, oxo-vanadyl phthalocyanine, copper phthalocyanine, aluminum chloride phthalocyanine, gallium chloride phthalocyanine, indium chloride phthalocyanine, germanium dichloride phthalocyanine, hydroxy aluminum phthalocyanine, hydroxy gallium phthalocyanine, hydroxy indium phthalocyanine, dihydroxy germanium phthalocyanine, tin phthalocyanine, tin oxide phthalocyanine, derivatives thereof, or any combinations thereof. In particular, examples of the phthalocyanine-based compound may be an oxo-titanyl phthalocyanine, such as d-type or y-type oxo-titanyl phthalocyanine having the strongest diffraction peak at a Bragg angle of about 27.1° (2θ±0.2°), a β-type oxo-titanyl phthalocyanine having the strongest diffraction peak at a Bragg angle of about 26.1° (2θ±0.2°), an α-type oxo-titanyl phthalocyanine having the strongest diffraction peak at a Bragg angle of about 7.5° (2θ±0.2°) in a powder X-ray diffraction peak; or a metal-free phthalocyanine pigment, such as X-type metal-free phthalocyanine or τ-type metal-free phthalocyanine having the strongest diffraction peak at Bragg angles of about 7.5° and about 9.2° (2θ±0.2°) in a powder X-ray diffraction peak. These phthalocyanine-based pigments may be effectively used in the present general inventive concept because the phthalocyanine-based pigments have the best sensitivity to light having a wavelength range of about 780 nm to about 800 nm and the sensitivities may be selected according to crystal structures thereof.

The phthalocyanine-based compound of Chemical Formula 1 or 2 used in the present disclosure may be synthesized by methods disclosed in F. H. Moser, A. L. Thomas, "Phthalocyanine Compounds", 1963; Japanese Patent Application Laid-Open Publication No. H1-142658; and Japanese Patent Application Laid-Open Publication No. H1-221461. Detailed descriptions thereof may be referred to the foregoing references. The disclosures of which are incorporated herein in its entirety by reference.

The charge generating material in the charge generation layer is dispersed and/or dissolved in a binder resin. Examples of a usable binder resin may be polyvinyl butyral, polyvinyl acetal, polyvinyl acetate, a polyester, a polyamide, polyvinyl alcohol, polyvinyl chloride, a polyurethane, a polycarbonate, polymethacrylic resin, polyvinylidene chloride, polystyrene, a styrene-butadiene copolymer, a styrene-methyl methacrylate copolymer, a vinylidene chloride-acrylonitrile copolymer, a vinyl chloride-vinyl acetate copolymer, a vinyl chloride-vinyl acetate-maleic anhydride copolymer, an ethylene-acrylic acid copolymer, an ethylene-vinyl acetate copolymer, a formal resin, a cellulose-based resin such as methyl cellulose, ethyl cellulose, nitrocellulose, or carboxymethyl cellulose, a silicone resin, a silicone-alkyd resin, a phenol-formaldehyde resin, a cresol-formaldehyde resin, a phenoxy resin, a styrene-alkyd resin, a poly-N-vinycarbazole resin, polyvinylformal, polyhydroxystyrene, a polycycloolefin, polyvinylpyrrolidone, poly(2-ethyl-oxazoline), a polysulfone, a melamine resin, a urea resin, an amino resin, an isocyanate resin, an epoxy resin, an acrylic resin, and a copolymer of monomers thereof. These binder resins may be used alone or in combination of two or more.

A weight ratio of the charge generating material to the binder resin may be in a range of about 1:0.3 to about 1:4 and particularly, may be in a range of about 1:0.5 to about 1:3 or about 1:0.5 to about 1:2. When the weight ratio of the binder resin is less than about 0.3, stability of coating slurry for forming a charge generation layer may decrease due to insufficient dispersion of the charge generating material, thus a uniform charge generation layer may be difficult to obtain during coating on the electrically conductive substrate, and adhesion may also decrease. When the weight ratio of the binder resin is greater than about 4, charge potential may not be maintained and a desired image quality may not be obtained due to insufficient sensitivity caused by a large amount of the binder resin.

A solvent used in preparation of the coating slurry may vary according to a type of the used binder resin, and it is preferable to select a solvent which does not affect the undercoat layer during coating of the charge generation layer. Particular examples of the solvent may be methyl isopropyl ketone, methyl isobutyl ketone, 4-methoxy-4-methyl-2-pentanone, isopropyl acetate, t-butyl acetate, isopropyl alcohol, isobutyl alcohol, acetone, methyl ethyl ketone, cyclohexanone, 1,2-dichloroethane, 1,1,2-trichloroethane, 1,1,1-trichloroethane, trichloroethylene, tetrachloroethane, dichloromethane, tetrahydrofuran, dioxane, dioxolane, methanol, ethanol, 1-propanol, 1-butanol, 2-butanol, 1-methoxy-2-propanol, ethyl acetate, butyl acetate, dimethyl sulfoxide, methylcellosolve, butyl amine, diethyl amine, ethylene diamine, isopropanol amine, triethanol amine, triethylene diamine, N,N'-dimethyl formamide, 1,2-dimethoxyethane, benzene, toluene, xylene, methylbenzene, ethylbenzene, cyclohexane, anisole, etc. These solvents may be used alone or in combination of two or more.

Next, a method of forming a charge generation layer is described. First, about 100 parts by weight of a charge generating material including a phthalocyanine pigment such as oxo-titanyl phthalocyanine and about 30 to 400 parts by weight, for example, about 50 to 200 parts by weight of a binder resin are mixed. A solvent is mixed to the foregoing mixture so as to obtain a solid content range of about 1 wt % to 8 wt %, for example, about 1 wt % to 5 wt %. Glass beads, steel beads, zirconia beads, alumina beads, zirconia balls, alumina balls, or steel balls are added to the mixture and the mixture is dispersed for about 2 hours to about 50 hours. At this time, a grinding or milling method may be used as a dispersion method. Examples of a usable dispersion apparatus may be an attritor, a ball mill, a sand mill, a Banburry mixer, a roll mill, a three-roll mill, a nanomiser, a microfluidizer, a stamp mill, a planetary mill, a vibration mill, a kneader, a homonizer, a Dyno-Mill, a micronizer, a paint shaker, a high-speed mixer, an ultimiser, an ultrasonicator, etc. These milling apparatuses may be used alone or in combination of two or more. The coating slurry for forming a charge generation layer may further include an additive. The additives, such as a dispersant, a photostabilizer, an antioxidant, an antifoaming agent, a surfactant, and a plasticizer, may be used alone or appropriately used in combination.

The coating slurry for forming a charge generation layer thus prepared is coated on the undercoat layer. Examples of a coating method may be a dip coating method, a ring coating method, a roll coating method, or a spray coating method. A charge generation layer may be formed by drying the substrate thus coated in a temperature range of about 90° C. to about 200° C. for about 0.1 hours to about 2 hours.

A thickness of the charge generation layer is particularly in a range of about 0.005 μm to about 5 μm, for example, about 0.05 μm to about 5 μm or about 0.1 μm to about 2 μm. When the thickness of the charge generation layer is less than about 0.005 μm, the charge generation layer may not be uniformly formed, and when the thickness of the charge generation layer is greater than about 5 μm, electrical characteristics tend to be degraded.

A charge transport layer (CTL) including a charge transporting material and a binder resin is formed on the charge generation layer. The charge transporting material functions to form an electrostatic latent image by transferring holes generated from the charge generation layer to a surface of the CTL through a conductive path formed in the CTL by light exposure. The charge transporting material includes a hole transporting material transporting holes and an electron transporting material transporting electrons. When the laminate type photoreceptor is used as a negatively-charged type, the hole transporting material is used as a major component of the charge transporting material. In this case, a small amount of the electron transporting material may be added in order to prevent a hole trap. A content of the electron transporting material is in a range of about 0 to 50 parts by weight, for example, about 5 to 30 parts by weight.

Particular examples of the hole transporting material which may be included in the chare transporting layer may be nitrogen containing cyclic compounds or condensed polycyclic compounds such as a hydrazone-based compound, a butadiene-based compound, a benzidine-based compound, a stilbene-based compound, a bisazo-based compound, a pyrene-based compound, a carbazole-based compound, an arylmethane-based compound, a thiazol-based compound, a styryl-based compound, a pyrazoline-based compound, an arylamine-based compound such as a diphenylamine-based compound and triphenylamine-based compound, an oxazole-based compound, an oxadiazole-based compound, a pyrazoline-based compound, a pyrazolone-based compound, a polyaryl alkane-based compound, a polyvinylcarbazole-based compound, a N-acrylamide methylcarbazole copolymer, a triphenylmethane copolymer, a styrene copolymer, polyacenaphthene, polyindene, a copolymer of acenaphthylene and styrene, and a formaldehyde-based condensed resin. Also, a high molecular weight compound having substituents of the above compounds in a main chain or a side chain may be used. The foregoing hole transporting materials when used may be used alone or in combination of two or more.

When the electron transporting material is included in the charge transporting material, a usable electron transporting material is not particularly limited and a known electron transporting material may be included. Particular examples of the electron transporting material may be electron transporting low molecular weight compounds such as a benzoquinone-based compound, a naphthoquinone-based compound, an anthraquinone-based compound, a malononitrile-based compound, a diphenoquinone-based compound, a fluorenone-based compound, a cyanoethylene-based compound, a cyanoquinodimethane-based compound, a xanthone-based compound, a phenanthraquinone-based compound, a phthalic anhydride-based compound, a thiopyran-based compound, a dicyanofluorenone-based compound, a naphthalenetetracarboxylic acid diimide compound, a benzoquinoneimine-based compound, a stilbenequinone-based compound, a diiminoquinone-based compound, a dioxotetracenedione compound, and a pyran sulfide-based compound. In addition, an electron transporting polymer compound or a pigment having n-type semiconductor characteristics may be used. The foregoing electron transporting materials may be used alone or in combination of two or more.

Particular examples of the hole transporting material may be 1,1-bis-(para-diethylaminophenyl)-4,4-diphenyl-1,3-butadiene, N,N'-bis(ortho,para-dimethylphenyl)-N,N'-diphenylbenzidine, 3,3'-dimethyl-N,N,N',N'-tetrakis-4-methylphenyl-(1,1'-biphenyl)-4,4'-diamine, N-ethyl-3-carbozolylaldehyde-N,N'-diphenylhydrazone, 4-(N,N-bis(para-toluyl)amino)-betaphenylstilbene, N,N,N',N'-tetrakis(3-methylphenyl)-1,3-diaminobenzene, N,N-diethylaminobenzaldehydediphenylhydrazone, N,N-dimethylaminobenzaldehydediphenylhydrazone, 4-dibenzylamino-2-methylbenzaldehydediphenylhydrazone, 2,5-bis(4-aminophenyl)-[1,3,4]oxadiazole, (2-phenylbenzo[5,6-b]-4H-thiopyran-4-ylidene)-propanedinitrile-1,1-dioxide, 4-bromo-triphenylamine, 4,4'-(1,2-ethanediylidene)-bis(2,6-dimethyl-2,5-cyclohexadiene-1-one), 3,4,5-triphenyl-1,2,4-triazole, 2-(4-methylphenyl)-6-phenyl-4H-thiopyran-4-ylidene-propanedinitrile-1,1-dioxide, 4-dimethylamino-benzaldehyde-N,N-diphenylhydrazone, 9-ethylcarbazole-3-aldehyde-N-methyl-N-phenylhydrazone, 5-(2-chlorophenyl)3-[2-(2-chlorophenyl)ethenyl]-1-phenyl-4,5-dihydro-1H-pyrazole, 4-diethylamino-benzaldehyde-N,N-diphenylhydrazone, N-biphenylyl-N-phenyl-N-(3-methylphenyl)amine, 9-ethylcarbazole-3-aldehyde-N,N-diphenylhydrazone, 3,5-bis(4-tert-butylphenyl)4-phenyltriazole, 3-(4-biphenylyl)-4-phenyl-5-tert-butylphenyl-1,2,4-triazole, 4-diphenylamino-benzaldehyde-N,N-diphenylhydrazone, 5-(4-diethylaminophenyl)-3-[2-(4-diethylaminophenyl)-ethenyl]-1-phenyl-4,5-dihydro-1-pyrazole, N,N'-di(4-methylphenyl)-N,N'-diphenyl-1,4-phenylenediamine, 4-dibenzylaminobenzaldehyde-N,N-diphenylhydrazone, 4-dibenzylamino-3-methylbenzaldehyde-N,N-diphenylhydrazone, 4,4'-bis(carbazole-9-yl)biphenyl, N,N,N',N'-tetraphenylbenzidine, N,N'-bis(4-methylphenyl)-N,N'-bis(phenyl)-benzidine, N,N'-bis(3-methylphenyl)-N,N'-bis(phenyl)benzidine, N,N,N',N'-tetrakis(4-methylphenyl)bezidine, N,N,N',N'-tetrakis(3-methylphenyl)bezidine, di(4-dibenzylaminophenyl)ether, N,N'-di(naphthalene-2-yl)-N,N'-diphenylbezidine, N,N'-di(naphthalene-1-yl)-N,N'-diphenylbezidine, 1,3-bis(4(4-diphenylamino)phenyl-1,3,4-oxadiazole-2-yl)benzene, N,N'-di(naphthalene-2-yl)N,N'-di(3-methylphenyl)bezidine, N,N'-di(naphthalene-1-yl)-N,N'-di(4-methylphenyl)bezidine, N,N'-di(naphthalene-2-yl)-N,N'-di(3-methylphenyl)bezidine, 1,1-bis(4-bis(4-methylphenyl)aminophenyl)cyclohexane, 4,4',4"-tris(carbazole-9-yl)-triphenylamine, 4,4',4"-tris(N,N-diphenylamino)-triphenylamine, N,N'-bis(biphenyl-1-yl)-N,N'-bis(naphth-1-yl)benzidine, 4,4',4"-tris(N-3-methylphenyl-N-phenylamino)triphenylamine, N,N,N',N'-tetrakis(biphenyl-4-yl)bezidine, 4,4',4"-tris(N-(1-naphthyl)-N-phenylamino)triphenylamine, and 4,4',4"-tris(N-(2-naphthyl)-N-phenylamino)triphenylamine. These hole transporting materials may be used alone or in combination of two or more.

If the charge transporting material itself has film-forming characteristics, the charge transporting layer may be formed without a binder resin, but usually low molecular materials do not have film-forming characteristics. Therefore, the charge transporting material is dissolved or dispersed with a binder resin in a solvent to prepare a coating composition(solution or dispersion) for forming a CTL, and then the solution or the dispersion is coated on the charge generating layer and dried to form the CTL. Examples of a binder resin which may be used for the CTL of the electrophotographic photoreceptor of the present general inventive concept include, but are not limited to, insulation resin which can form a film, such as polyvinyl butyral, polyarylates (condensed polymer of bisphenol A and phthalic acid, and so on), a polycarbonate, a polyester resin, a phenoxy resin, polyvinyl acetate, an acrylic resin, a polyacrylamide resin, a polyamide, polyvinyl pyridine, a cellulose-based resin, a urethane resin, an epoxy resin, a silicone resin, polystyrene, a polyketone, polyvinyl chloride, vinyl chloride-vinyliacetate copolymer, polyvinyl acetal, polyacrylonitrile, a phenolic resin, a melamine resin, casein, polyvinyl alcohol, and polyvinyl pyrrolidone; and an organic photoconductive polymer, such as poly N-vinyl carbazole, polyvinyl anthracene, polyvinyl pyrene, and so on. In particular, a polycarbonate resin may be used as the binder resin for a charge transport layer and among the polycarbonate resin, polycarbonate-A derived from bisphenol A or polycarbonate-C derived from methylbisphenol-A, and polycarbonate-Z derived from cyclohexylidene bisphenol may be used. Polycarbonate-Z may have a high wear resistance. These binder resins may be used alone or in combination of two or more.

A weight ratio of the charge transporting material to the binder resin in the CTL may be in a range of about 1:0.5 to about 1:2, for example, about 1:0.5 to about 1:1.6. When the weight ratio of the binder resin is less than about 0.5, stability of a coating composition for forming the CTL may decrease due to insufficient dispersion of the charge transporting material and adhesion and mechanical strength of the CTL may decrease. When the weight ratio of the binder resin is greater than about 2, sensitivity may be insufficient due to insufficient charge transporting ability and residual potential tends to increase.

A solvent used in preparation of a coating composition for forming the CTL may vary according to a type of the used binder resin, and may preferably be selected in such a way that it does not affect the charge generating layer formed underneath. Specifically, particular examples of the solvent may be, for example, aromatic hydrocarbons such as benzene, xylene, ligroin, monochlorobenzene, and dichlorobenzene; ketones such as acetone, methyl ethyl ketone, and cyclohexanone; alcohols such as methanol, ethanol, and isopropanol; esters such as ethyl acetate and methyl cellosolve; halogenated aliphatic hydrocarbons such as carbon tetrachloride, chloroform, dichloromethane, dichloroethane, and trichloroethylene; ethers such as tetrahydrofuran(THF), dioxane, dioxolan, ethylene glycol, and monomethyl ether; amides such as N,N-dimethyl formamide, N,N-dimethyl acetamide; and sulfoxides such as dimethyl sulfoxide. The foregoing solvents may be used alone or in combination of one or two.

Next, a method of forming a charge transport layer will be described. First, about 100 parts by weight of a charge transporting material and about 50 to 200 parts by weight, for example, about 100 to 160 parts by weight of a binder resin are mixed. A solvent is mixed to the foregoing mixture so as to obtain a solid content range of about 10 wt % to 30 wt %, for example, about 15 wt % to 25 wt %. The coating composition for forming a charge transport layer may further include an additive. The additives, such as an antioxidant, a dispersant, a photostabilizer, an antifoaming agent, a surfactant, a plasticizer, and an oil, may be used alone or appropriately used in combination. The coating composition for forming a charge transport layer may include a known phosphate-based compound, a phosphine oxide-based compound, and a silicone oil in order to improve wear resistance and provide lubricating characteristics (slip property) to a charge transport layer surface.

The coating composition for forming a charge transport layer thus prepared is coated on the charge generation layer. The foregoing coating methods, such as a dip coating method, a ring coating method, a roll coating method, and a spray coating method, may also be used. The CTL may be formed by drying the substrate thus coated with the CTL in a temperature range of about 90° C. to about 200° C. for about 0.1 hours to about 2 hours.

A thickness of the CTL may be in a range of about 5 μm to about 50 μm, for example, about 10 μm to about 40 μm, for example, greater than about 18 μm and equal to or less than about 40 μm, or about 20 μm or more and about 36 μm or less, and for example, may be about 22 μm or more and about 34 μm or less. When the thickness of the CTL is less than about 5 μm, durability may be insufficient because the thickness thereof is too small and charge characteristics may degrade, and when the thickness of the charge generation layer is greater than about 50 μm, durability may increase but a response rate tends to decrease and image quality tend to deteriorate. A total thickness of the CGL and the CTL may be generally set in a range of about 5 μm to about 50 μm.

Also, the electrophotographic photoreceptor of the present disclosure may further include a surface protective layer on the CTL, if necessary.

The electrophotographic photoreceptor thus obtained according to an embodiment of the present disclosure may have a large charge transport layer thickness of greater than about 18 μm and equal to or less than about 40 μm and also, may have a fast characteristic response time of about 10 msec or more and about 85 msec or less. For example, the electrophotographic photoreceptor according to the embodiment of the present general inventive concept may have a charge transport layer thickness of about 20 μm or more and about 36 μm or less, for example, about 22 μm or more and about 34 μm or less, and may have a characteristic response time of about 20 msec or more and about 75 msec or less, for example, about 25 msec or more and about 75 msec. Herein, the characteristic response time is defined as a shortest response time in a range of response times generating characteristic photoinduced discharge curves (PIDC), and the response time is defined as a time elapsed from the moment of light exposure of the laminate type electrophotographic photoreceptor to the moment of development thereof. The characteristic PIDC is defined, in a photoinduced discharge characteristic test in which the laminate type electrophotographic photoreceptor is charged to have an initial surface potential range of about −500 V to about −700 V by using a direct current (DC) contact charging method in an environment of a temperature of 23° C. and a relative humidity of 50% and, thereafter, the laminate type electrophotographic photoreceptor is exposed to monochromatic light having a wavelength of about 780 nm, as a PIDC exhibiting a saturation phenomenon in which the surface potential of the laminate type electrophotographic photoreceptor after the light exposure is in a range of about 0 V to about −200 V and the surface potential of the laminate type electrophotographic photoreceptor after the light exposure does not change about ±10 V or more even when exposure energy increases 10 times. More detailed descriptions related to this will be provided below. A response time, i.e., a response rate, relates to a rate in which holes in the CTL move to a surface of the CTL to neutralize negative charges of the surface. The characteristic response time may be determined according to characteristics and content of the charge transporting material and an electrophotographic photoreceptor according to an aspect of the present general inventive concept may realize a fast characteristic response time. Accordingly, the electrophotographic photoreceptor according to an aspect of the present general inventive concept may resolve limitations of a typical electrophotographic photoreceptor, in which high residual potential, low initial charge potential, low charge capacity, and increased dark decay occur, even when the thickness of the CTL increases. Therefore, the electrophotographic photoreceptor according to an embodiment of the present general inventive concept may realize a fast response time of about 85 msec or less such that the thickness of the CTL may be increased to more than about 18 μm. As a result, both excellent lifetime characteristics and excellent charge stain characteristics may be obtained.

The electrophotographic photoreceptor may be incorporated into an electrophotographic cartridge of an electrophotographic imaging apparatus such as a laser printer, a copying machine, a facsimile machine, an LED printer, and the like.

An electrophotographic image forming apparatus according to another aspect includes the electrophotographic photoreceptor, a charging device charging the electrophotographic photoreceptor in contact with the electrophotographic photoreceptor; an exposure device forming an electrostatic latent image on a surface of the electrophotographic photoreceptor; a developing device developing the electrostatic latent image to form a visible image; a transferring device transferring the visible image on an image receiving member; and a cleaning device cleaning the surface of the electrophotographic photoreceptor after the transferring.

An electrophotographic cartridge according to another aspect of may integrally support an electrophotographic photoreceptor; and at least one device selected from the group consisting of a charging device charging the electrophotographic photoreceptor in contact with the electrophotographic photoreceptor, a developing device developing an electrostatic latent image formed on the electrophotographic photoreceptor to form a visible image, a transferring device transferring the visible image on an image receiving member and a cleaning device cleaning a surface of the electrophotographic photoreceptor after transferring, and may be attached to an electrophotographic image forming apparatus and detachable from the electrophotographic image forming apparatus.

FIG. 1 is a schematic view illustrating an embodiment of an electrophotographic image forming apparatus and an electrophotographic cartridge including an electrophotographic photoreceptor according to an embodiment of the present general inventive concept.

Referring to FIG. 1, an electrophotographic photoreceptor drum 11 is charged with a direct voltage by a charging roller 13 which is a charging device disposed in contact with the electrophotographic photoreceptor drum 11. Next, an electrostatic latent image is formed on the electrophotographic photoreceptor drum 11 by exposing an image portion with a laser beam. The electrostatic latent image is developed to a visible image, for example, a toner image, by a developing device 15 and the toner image is then transferred to an image receiving member 19 by a transferring roller 17 with a voltage applied. A toner remaining on a surface of the electrophotographic photoreceptor drum 11 after the image transferring is cleaned by a cleaning device, e.g., a cleaning blade 21. Subsequently, the electrophotographic photoreceptor drum 11 may be used again for forming an image. The developing device 15 includes a regulating blade 23, a developing roller 25, or a feeding roller 27.

An electrophotographic cartridge 29 may integrally support the electrophotographic photoreceptor drum 11 and if necessary, the charging device 13, the developing device 15, and the cleaning device 21, may be attached to an electrophotographic image forming apparatus 31, and may also be detached from the electrophotographic image forming apparatus 31.

Hereinafter, the present disclosure is described in detail according to examples. However, the following examples are merely presented to exemplify the present general inventive concept, and the scope of the present general inventive concept is not limited thereto. In the following examples, effects of the response rate on charge stains according to a thickness range of the CTL will be mainly described.

REFERENCE EXAMPLE

The present Reference Example is for describing preparation of the electrophotographic photoreceptor having a charge transport layer thickness of 18 μm as in the prior art.

About 4.6 parts by weight of Y-type oxo-titanyl phthalocyanine, about 3.1 parts by weight of a polyvinyl butyral resin (BM2: Sekisui Chemical Co., Ltd.), and about 81.6 parts by weight of a tetrahydrofuran (THF) solvent were mixed and milled together with glass beads having a diameter of about 1 mm to about 1.5 mm by using a paint shaker and a ball mill to obtain a dispersion having an average particle size of about 250 nm. THF having an amount of about 3.8 times of that of the dispersion was further added to the dispersion and ultrasonicated for about 30 minutes to prepare a stable coating slurry for a charge generation layer.

About 7.5 parts by weight of N,N,N',N'-tetrakis(4-methylphenyl)-benzidine (charge transporting material A), about 11 parts by weight of a polycarbonate binder resin (B-500, Idemitsu Kosan CO., LTD.), about 0.4 parts by weight of dibutylhydroxytoluene as an antioxidant, and about 0.02 parts by weight of a silicone oil were dissolved in about 82.58 parts by weight of THF to prepare a coating solution for a charge transport layer.

An alumite-treated aluminum drum (an external diameter of about 30 mm, a length of about 360 mm, a thickness of about 1 mm) was coated with the coating slurry for a charge generation layer by using a dip coating method and dried at about 100° C. for about 50 minutes to form a CGL having a layer thickness of about 0.4 μm.

The CGL thus formed was coated with the coating solution for a charge transport layer by using a dip coating method and first dried at about 100° C. for about 30 minutes, and cooled to room temperature. Subsequently, the CTL having a layer thickness of about 18 μm was formed by secondary drying at about 130° C. for about 30 minutes.

Example 1

An electrophotographic photoreceptor was prepared in the same manner as Reference Example except that a layer thickness of a CTL after drying was set to be about 21 μm.

Example 2

An electrophotographic photoreceptor was prepared in the same manner as Reference Example except that a layer thickness of the CTL after drying was set to be about 26 μm.

Example 3

An electrophotographic photoreceptor was prepared in the same manner as Reference Example except that about 10 parts by weight of tris-4-(4,4-diphenyl-1,3-butadienyl phenyl)amine (CAS No. 182481-38-5, charge transporting material B) was used instead of using the charge transporting material A and a layer thickness of the CTL after drying was set to be about 26 μm.

Example 4

An electrophotographic photoreceptor was prepared in the same manner as Reference Example except that about 7.5 parts by weight of tris-4-(4,4-diphenyl-1,3-butadienyl phenyl)amine was used instead of using the charge transporting material A and a layer thickness of the CTL after drying was set to be about 26 μm.

Example 5

An electrophotographic photoreceptor was prepared in the same manner as Reference Example except that about 9 parts by weight of 9,9-dimethyl-N,N-di(p-tolyl)-9H-fluoren-2-amine (charge transporting material C) was used instead of using the charge transporting material A and a layer thickness of the CTL after drying was set to be about 26 μm.

Example 6

An electrophotographic photoreceptor was prepared in the same manner as Example 5 except that the use amount of 9,9-dimethyl-N,N-di(p-tolyl)-9H-fluoren-2-amine was changed to about 7 parts by weight.

Example 7

An electrophotographic photoreceptor was prepared in the same manner as Example 4 except that a layer thickness of the CTL after drying was set to be about 30 μm.

Example 8

An electrophotographic photoreceptor was prepared in the same manner as Example 4 except that a layer thickness of the CTL after drying was set to be about 34 μm.

Comparative Example 1

An electrophotographic photoreceptor was prepared in the same manner as Reference Example except that a layer thickness of the CTL after drying was set to be about 30 μm.

Comparative Example 2

An electrophotographic photoreceptor was prepared in the same manner as Reference Example except that a layer thickness of the CTL after drying was set to be about 34 μm.

Comparative Example 3

An electrophotographic photoreceptor was prepared in the same manner as Example 5 except that the use amount of 9,9-dimethyl-N,N-di(p-tolyl)-9H-fluoren-2-amine was changed to about 5.5 parts by weight.

Comparative Example 4

An electrophotographic photoreceptor was prepared in the same manner as Example 3 except that the use amount of tris-4-(4,4-diphenyl-1,3-butadienyl phenyl)amine was changed to about 5 parts by weight.

Evaluation Methods

<Characteristic Response Time Measurement>

Characteristic response times of the electrophotographic photoreceptor drums obtained in Reference Example, Examples 1 to 8, and Comparative Examples 1 to 4 were measured by using a photoinduced discharge characteristic measurement apparatus (Gentec Corporation, Cynthia Model 92KSS) in an environment of a temperature of about 23° C. and a relative humidity of about 50%.

Figure 2:
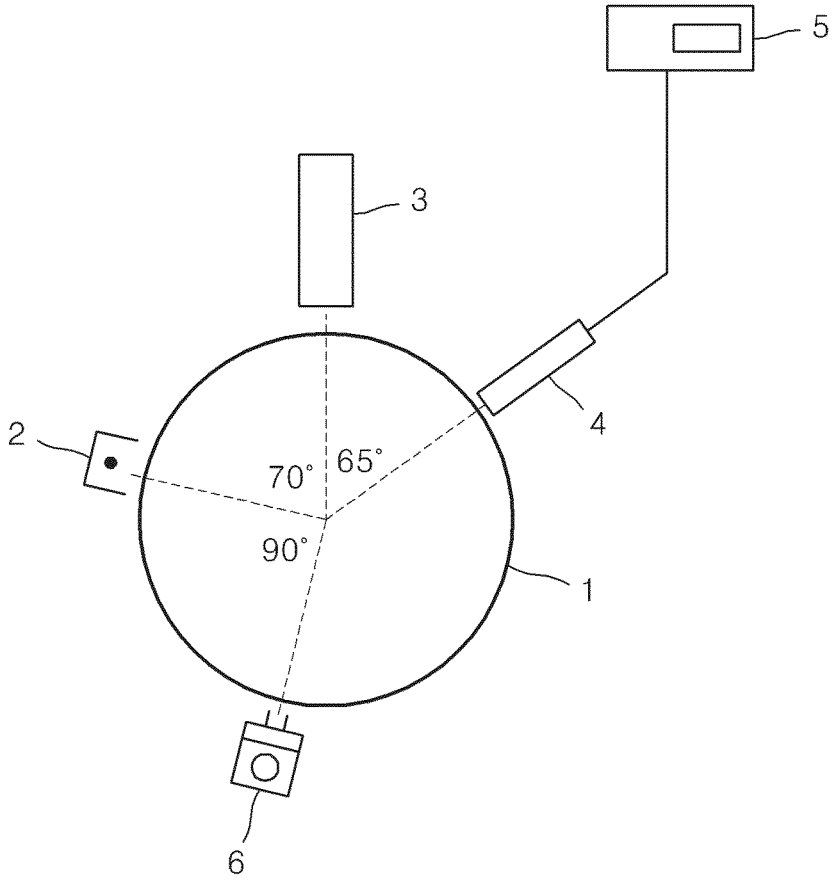
FIG. 2 is a schematic view illustrating an arrangement geometry of an electrophotographic photoreceptor drum 1, a charging device 2, an exposure device 3, a probe 4, a surface potential meter 5, and a charge neutralization device 6 in an apparatus for measuring photoinduced discharge characteristics.

FIG. 2 is a schematic view illustrating an arrangement geometry of an electrophotographic photoreceptor drum 1, a charging device 2, an exposure device 3, a probe 4, a surface potential meter 5, and a charge neutralization device 6 in the measurement apparatus. Referring to FIG. 2, the photoreceptor drum 1 charged by the charging device 2 was exposed by the exposure device 3. The charging device 2 charges the photoreceptor drum 1 under the following conditions so as to obtain an initial surface potential range of the photoreceptor drum 1 of about −500 V to about −700 V.

Charging method: a DC contact charging method

Charging device: a charging roller having an external diameter of about 12 mm and a resistance of about 0.4 MΩ

Applied charging voltage: about −1,250 V

An external diameter of the photoreceptor drum 1: about 30 mm

A light source for the exposure was a light-emitting diode having a wavelength of about 780 nm. Thereafter, a surface potential after the exposure was measured through the surface potential meter 5 connected to the probe 4 installed at a position of a developing device. At this time, an angle between the exposure device 3 and the probe 4 installed at the position of the developing device was about 65 degrees. A surface of the photoreceptor drum 1 was uniformly irradiated by the charge neutralization device 6 to flood the surface of the photoreceptor drum 1. A light source for the charge neutralization was a light-emitting diode having a wavelength range of about 640 nm to about 680 nm. The measurement apparatus was stabilized by performing a cycle composed of charging-exposure-charge neutralization for three times. Thereafter, light exposures were performed to obtain photoinduced discharge curves (PIDC) with respect to the electrophotographic photoreceptor drums obtained in Reference Example, Examples 1 to 8, and Comparative Examples 1 to 4 while exposure energy discharged from the exposure device 3 was increased as the cycle repeated.

A response time, which is defined as a time elapsed from the moment of light exposure 3 of the laminate type electrophotographic photoreceptor to the moment of development 4 thereof, may be calculated by using an angle between the exposure device 3 and the probe 4 installed at the position of the development device of about 65 degrees, a rotational velocity of the photoreceptor drum 1, and an external diameter of the photoreceptor drum 1. A series of photoinduced discharge curves were obtained by stepwise increasing the response time from about 10 msec to about 400 msec, that is, by stepwise decreasing the revolutions per minute (rpm) of the photoreceptor drum 1 from about 1,083 rpm to about 27 rpm. Among these photoinduced discharge curves, a characteristic photoinduced discharge curve exhibiting a saturation phenomenon was selected, in which a surface potential of a laminate type electrophotographic photoreceptor after the exposure was in a range of about 0 V to about −200 V and also, the surface potential of the laminate type electrophotographic photoreceptor after the exposure did not change to about ±10 V or more even when exposure energy increased about 10 times. Then, the shortest response time in a range of a response time generating the characteristic photoinduced discharge curves may be selected as "characteristic response time".

Figure 3:
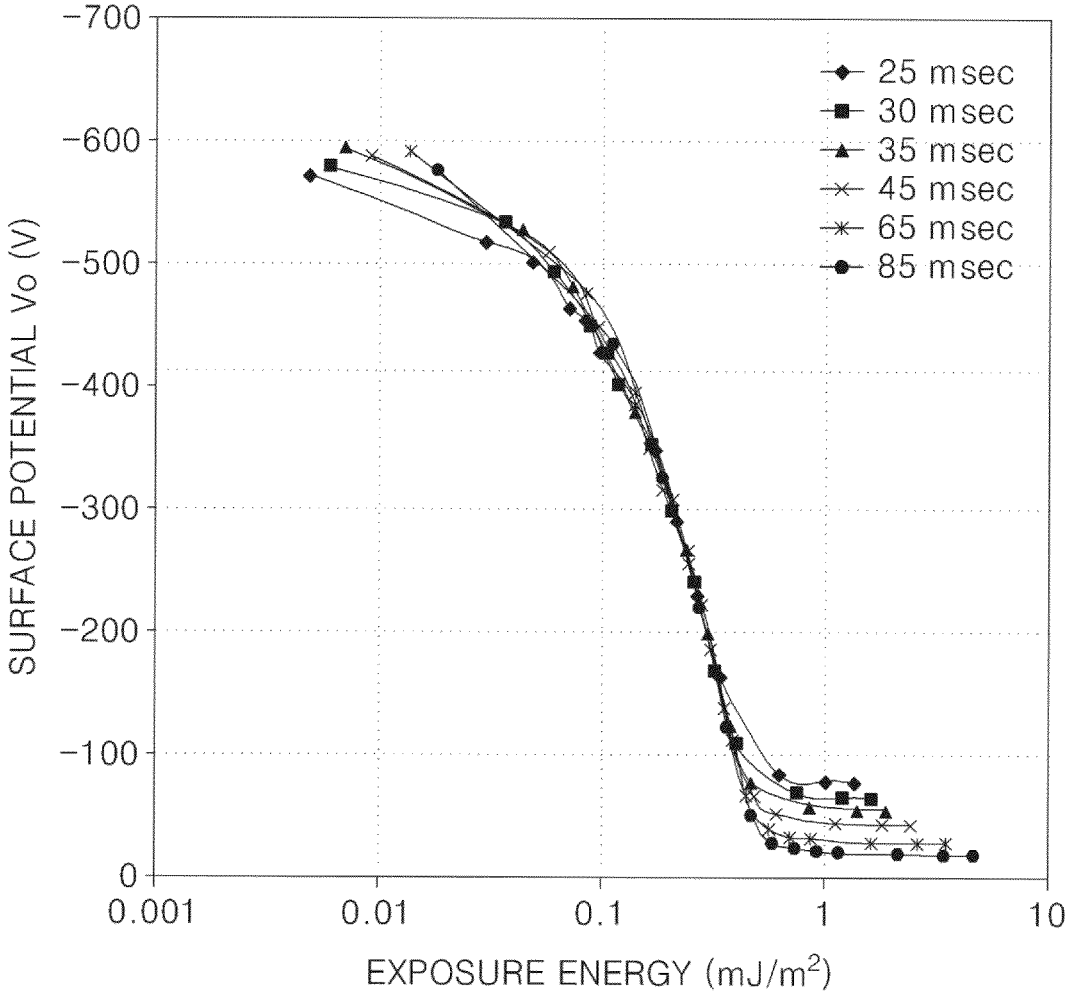
FIGS. 3 and 4 are a series of photoinduced discharge curves (PIDC) of two different electrophotographic photoreceptor drums in a response time range of about 25 msec to about 85 msec, respectively.
Figure 4:
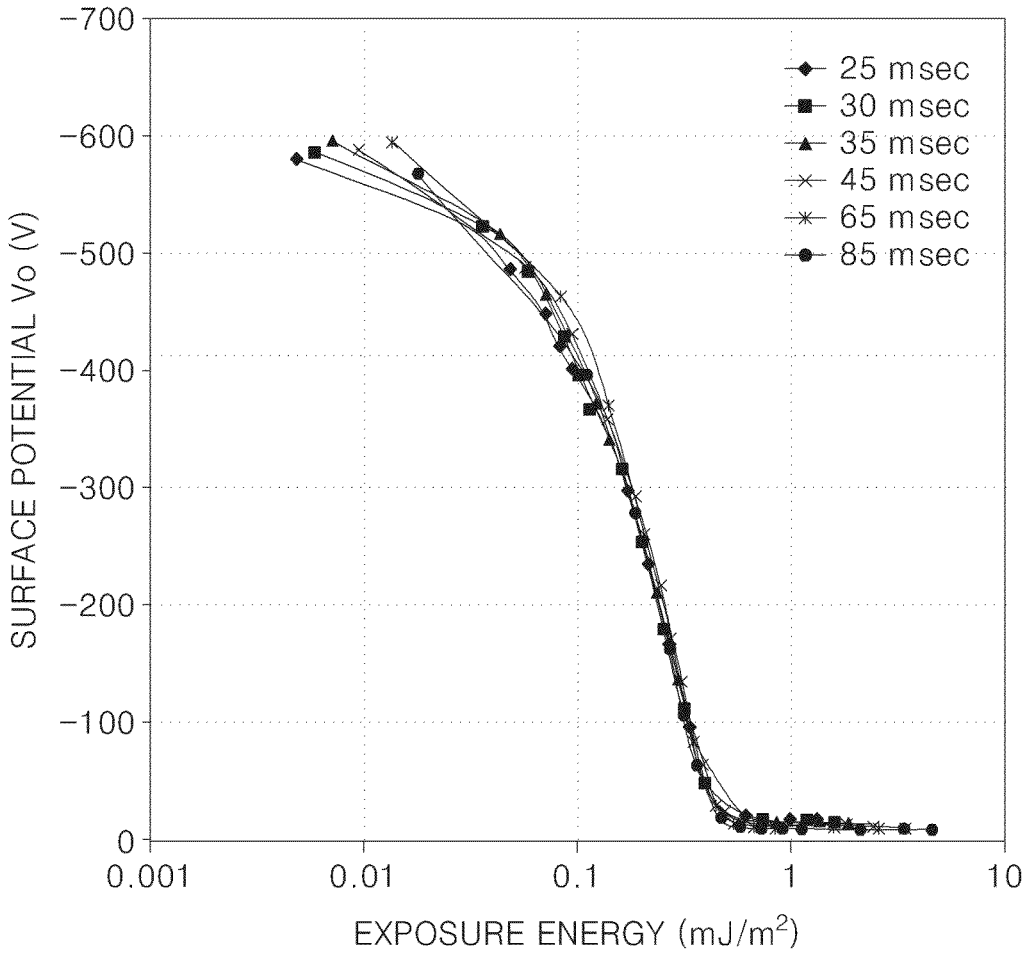

FIGS. 3 and 4 are a series of characteristic photoinduced discharge curves of two different electrophotographic photoreceptor drums in a response time range of about 25 msec to about 85 msec, respectively. In FIGS. 3 and 4, x-axis denotes changes in exposure energy (a logarithmic scale). Y-axis denotes changes in a surface potential (negative potential). FIG. 3 illustrates characteristic PIDC of the photoreceptor drum having a slow response rate and FIG. 4 illustrates characteristic PIDC of the photoreceptor drum having a fast response rate. With respect to the former, the characteristic photoinduced discharge curves were distributed in a wide range. On the other hand, with respect to the latter, the characteristic photoinduced discharge curves were distributed in a narrow range.

Figure 5:
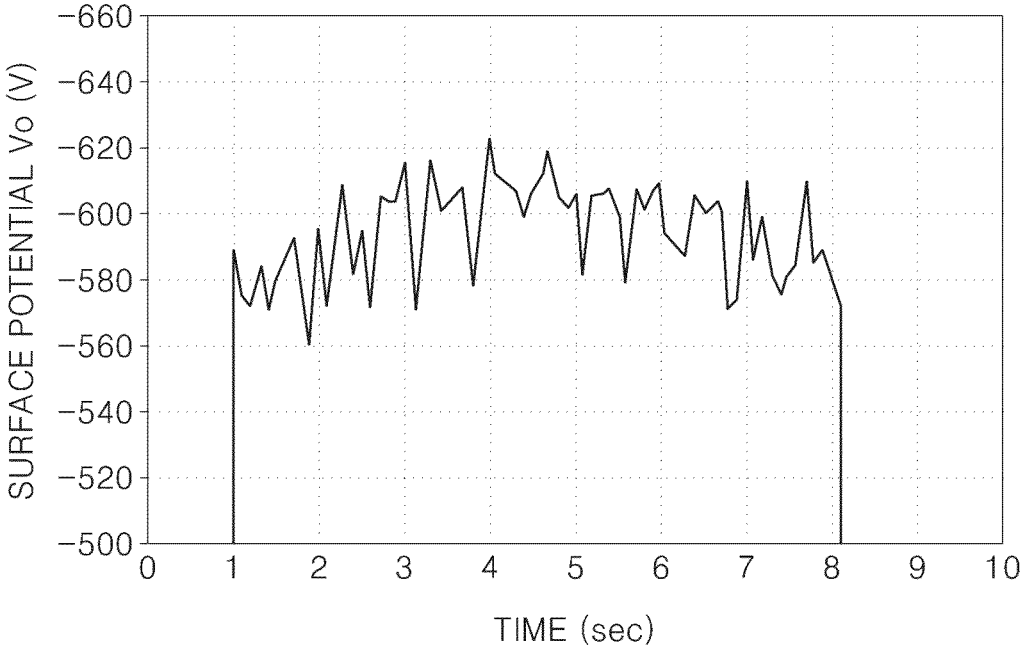
FIGS. 5 and 6 illustrate changes in surface potentials of the two different electrophotographic photoreceptor drums of FIGS. 3 and 4 according to a time elapsed before light exposure, respectively.
Figure 6:
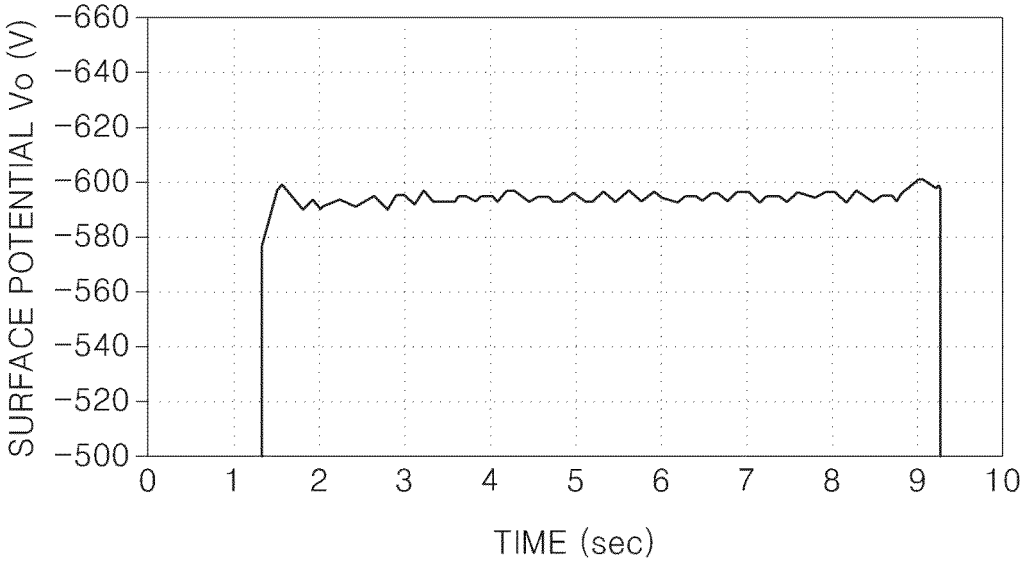

FIGS. 5 and 6 illustrate changes in surface potentials of the two different electrophotographic photoreceptor drums of FIGS. 3 and 4 as time elapses before light exposure, respectively. Referring to FIG. 5, with respect to the photoreceptor drum having a slow response rate, it may be understood that considerable charge stains may occur because changes in the surface potential may be very large as time elapsed. Referring to FIG. 6, with respect to the photoreceptor drum having a fast response rate, it may be understood that considerable charge stains may not occur because the surface potential may be relatively stable as time elapsed.

<Evaluation of Charge Stain Level>

Charge stain levels were visually evaluated by using the following method with respect to halftone pattern images (a width of about 18 cm, a length of about 25 cm) obtained by printing with a color printer (Samsung Electronics Co., Ltd. Model CLP660) using the electrophotographic photoreceptor drums obtained in Reference Example, Examples 1 to 8, and Comparative Examples 1 to 4 and converted to a DC charging method in an environment of a temperature of about 23° C. and a relative humidity of about 50%.

Level 0: the case where transverse fine lines are not observed.

Level 1: the case where the number of high-density transverse fine lines having a length range of about 1 cm to about 2 cm is about 10 or less.

Level 2: the case where the number of high-density transverse fine lines having a length of about 5 cm or less is about 30 or less.

Level 3: the case where high-density transverse fine lines having a length of greater than about 5 cm occur and some of the fine lines are overlapped.

Levels equal to or less than Level 1 represent a state in which limitations of image quality are not generated. Levels greater than Level 1 and less than Level 2 represent a state in which image stains may be recognized when the image is closely observed. Levels equal to or greater than Level 2 and equal to or less than Level 3 represent a state of being evaluated as poor image quality.

Figure 7:
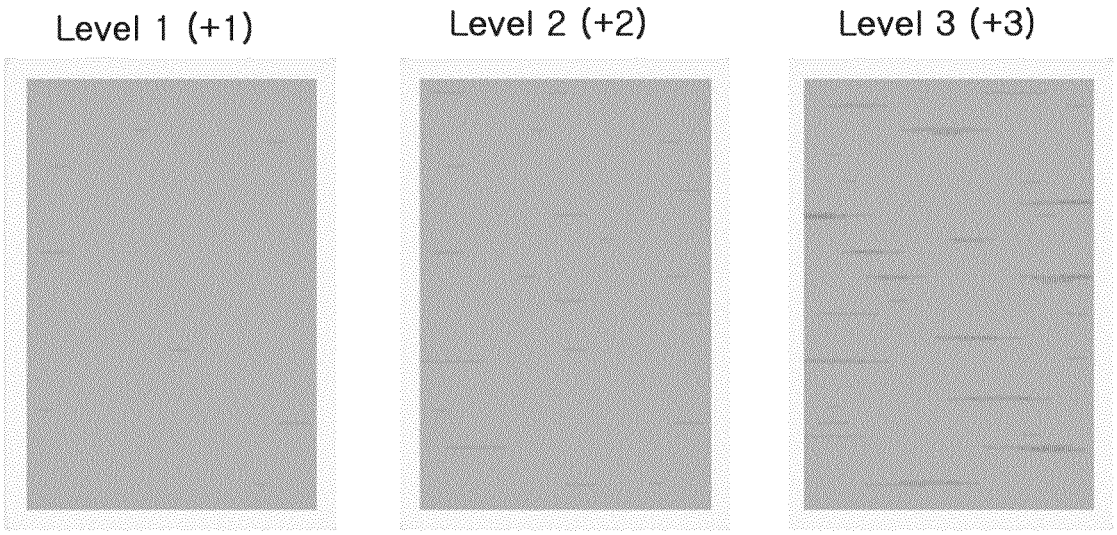
FIG. 7 illustrates states of microjitter when charge stains of printed images are levels 1, 2, and 3, respectively.

FIG. 7 illustrates states of microjitter (transverse fine lines) when charge stains of printed images are levels 1, 2, and 3, respectively.

Tables 1 and 2 summarize configurations and evaluation results of the electrophotographic photoreceptor drums obtained in Reference Example, Examples 1 to 8, and Comparative Examples 1 to 4.

TABLE 1

| | | | When charge transport layer thickness is changed | | | | | When characteristic response time is changed | | | |
|---|---|---|---|---|---|---|---|---|---|---|---|
| | | | Reference Example | Example 1 | Example 2 | Comparative Example 1 | Comparative Example 2 | Example 3 | Example 4 | Example 5 | Example 6 |
| Photo-receptor drum | External diameter of photoreceptor drum | mm | 30 | 30 | 30 | 30 | 30 | 30 | 30 | 30 | 30 |
| | Charge transport layer thickness | μm | 18 | 22 | 26 | 30 | 34 | 26 | 26 | 26 | 26 |
| | Characteristic response time | msec | 85 | 85 | 85 | 85 | 85 | 25 | 45 | 65 | 75 |
| | Charge transporting material type | Type | A | A | A | A | A | B | B | C | C |
| | Use amount of charge transporting material | Parts by weight | 7.5 | 7.5 | 7.5 | 7.5 | 7.5 | 10 | 7.5 | 9 | 7 |
| Charging roller | External diameter | mm | 12 | 12 | 12 | 12 | 12 | 12 | 12 | 12 | 12 |
| | Resistance | MΩ | 0.4 | 0.4 | 0.4 | 0.4 | 0.4 | 0.4 | 0.4 | 0.4 | 0.4 |
| Applied charging voltage | | V | −1250 | −1250 | −1250 | −1250 | −1250 | −1250 | −1250 | −1250 | −1250 |
| Initial surface potential ($V_0$) | | V | −687 | −665 | −627 | −596 | −565 | −627 | −627 | −627 | −627 |
| Charge stain level | | level | 0 | 1 | 1.5 | 2 | 3 | 0 | 0 | 0.5 | 0.5 |

TABLE 2

| | | | When charge transport layer thickness is changed | | When characteristic response time is changed | | |
|---|---|---|---|---|---|---|---|
| | | | Example 7 | Example 8 | Example 2 | Comparative Example 3 | Comparative Example 4 |
| Photo-receptor drum | External diameter of photoreceptor drum | mm | 30 | 30 | 30 | 30 | 30 |
| | Charge transport layer thickness | μm | 30 | 34 | 26 | 26 | 26 |

TABLE 2-continued

| | | | When charge transport layer thickness is changed | | When characteristic response time is changed | | |
|---|---|---|---|---|---|---|---|
| | | | Example 7 | Example 8 | Example 2 | Comparative Example 3 | Comparative Example 4 |
| | Characteristic response time | msec | 45 | 45 | 85 | 95 | 105 |
| | Charge transporting material type | Type | B | B | A | C | B |
| | Use amount of charge transporting material | Parts by weight | 7.5 | 7.5 | 7.5 | 5.5 | 5 |
| Charging roller | External diameter | mm | 12 | 12 | 12 | 12 | 12 |
| | Resistance | MΩ | 0.4 | 0.4 | 0.4 | 0.4 | 0.4 |
| Applied charging voltage | | V | −1250 | −1250 | −1250 | −1250 | −1250 |
| Initial surface potential ($V_0$) | | V | −590 | −571 | −627 | −627 | −627 |
| Charge stain level | | level | 0.5 | 0.5 | 1.5 | 2 | 3 |

Referring to Tables 1 and 2, the photoreceptor of Reference Example having a charge transport layer thickness of 18 μm, the maximum thickness of a charge transport layer practically selectable in a typical practical photoreceptor, had a characteristic response time of about 85 msec and a charge stain level of 0 and thus, it may be confirmed that the photoreceptor of Reference Example had satisfactory characteristics. However, with respect to the foregoing photoreceptor, limitations in service lifetime are expected when the photoreceptor is used by a contact charging method because the CTL thickness was only about 18 μm.

All photoreceptors of Examples 1 and 2 and Comparative Examples 1 and 2, which had the same type of charge transporting material A and density of the charge transporting material as those in the photoreceptor of Reference Example and also, had a gradually increasing charge transport layer thickness, exhibited characteristic response times of about 85 msec as in the case of the photoreceptor of Reference Example. Charge stain levels of the photoreceptors of Examples 1 and 2 increased more than that of the photoreceptor of Reference Example, but all the photoreceptors of Examples 1 and 2 showed good charge stain levels of less than 2 regardless of the more increased charge transport layer thickness. Therefore, satisfactory charge stain characteristics and increased service lifetime may be expected when the photoreceptors of Examples 1 and 2 are used by a contact charging method.

However, with respect to the photoreceptors of Comparative Examples 1 and 2, charge stain levels thereof were 2 or more and exceeded a utilization limit because the CTL thicknesses thereof excessively increased in comparison to low response rates with a characteristic response time of about 85 msec. On the other hand, both photoreceptors of Examples 7 and 8 using the same type of charge transporting material B and density of the charge transporting material exhibited short characteristic response times of about 45 msec. However, since response rates in this case were fast, both charge stain levels were about 0.5 and good even when the CTL thickness was increased from about 30 μm (Example 7) to about 34 μm (Example 8). Therefore, satisfactory charge stain characteristics and increased service lifetime may be expected when the photoreceptors of Examples 7 and 8 are used by a contact charging method.

When charge stain levels of the photoreceptors of Examples 2 to 6 and Comparative Examples 3 and 4, in which characteristic response times and charge transporting material types were changed while the CTL thicknesses were fixed to about 26 μm, were compared to one another, all of the charge stain levels were good with respect to the photoreceptors of Examples 2 to 6 having a characteristic response time range of about 25 msec to about 85 msec and the charge stain levels were particularly good with respect to the photoreceptors of Examples 3 to 6 having a characteristic response time range of about 25 msec to about 75 msec. Charge stain characteristics of the photoreceptor of Example 2 were not better than those of the photoreceptors of Examples 3 to 6, but may be evaluated as good in consideration of having a characteristic response time of about 85 msec. On the other hand, with respect to the photoreceptors of Comparative Examples 3 to 4 having a characteristic response time of about 95 msec or more, a utilization limit was exceeded because the charge stain levels thereof were 2 or more.

Accordingly, when the characteristic response time was about 85 msec or more, it may be confirmed that a charge stain level exceeded a utilization limit when the CTL thickness increased to about 30 μm or more. On the other hand, when the characteristic response time was about 80 msec or less, for example, about 75 msec or less, it may be confirmed that a charge stain level was very good even when the CTL thickness increased to about 34 μm. Therefore, the electrophotographic photoreceptor according to the present general inventive concept may not be affected by charge stains even when the CTL thickness is large in order to secure a long lifetime.

When the thickness of a charge transport layer in a typical laminate type electrophotographic photoreceptor according to the prior art is increased in order to increase the lifetime thereof, an amount of residual electric charge may decrease due to a decrease in charge capacity and charge stains may be facilitated. However, a laminate type electrophotographic photoreceptor according to the present general inventive concept has an improved fast characteristic response time and thus, charge stain characteristics are excellent even when a thick charge transport layer is employed. Therefore, the laminate type electrophotographic photoreceptor of the present general inventive concept may have both excellent lifetime characteristics and excellent charge stain characteristics. When the laminate type electrophotographic photoreceptor of the present general inventive concept is used, an image having excellent image quality may be obtained over a long period of time. For example, when the laminate type electrophotographic photoreceptor of the present general inventive concept is used, limitations of the DC contact charge method, in which charge stains in a line shape are generated in a perpendicular direction with respect to a moving direction of a charged surface due to charge non-uniformity, may be resolved.

While the present disclosure has been particularly shown and described with reference to exemplary embodiments thereof, it will be understood by those of ordinary skill in the art that various changes in form and details may be made therein without departing from the spirit and scope of the present disclosure as defined by the following claims.

What is claimed is:

1. A laminate type electrophotographic photoreceptor comprising:

an electrically conductive substrate; and an undercoat layer (UL), a charge generation layer (CGL), and a charge transport layer (CTL) sequentially disposed on the electrically conductive substrate, wherein a characteristic response time of the photoreceptor is about 10 msec or more and about 85 msec or less and a thickness of the charge transport layer is equal to or greater than about 21 μm and equal to or less than about 45 μm:

wherein the characteristic response time is denoted as a shortest response time in a range of response times generating characteristic photoinduced discharge curves (PIDC), the response time is denoted as a time elapsed from the moment of light exposure of the laminate type electrophotographic photoreceptor to the moment of development thereof, and the characteristic PIDC is denoted, in a photoinduced discharge characteristic test in which the laminate type electrophotographic photoreceptor is charged to have an initial surface potential range of about −500 V to about −700 V by using a direct current (DC) contact charging method in an environment of a temperature of 23° C. and a relative humidity of 50% and, thereafter, the laminate type electrophotographic photoreceptor is exposed to monochromatic light having a wavelength of about 780 nm, as a PIDC exhibiting a saturation phenomenon in which the surface potential of the laminate type electrophotographic photoreceptor after the light exposure is in a range of about 0 V to about −200 V and the surface potential of the laminate type electrophotographic photoreceptor after the light exposure does not change about ±10 V or more even when exposure energy increases 10 times.

2. The laminate type electrophotographic photoreceptor of claim 1, wherein the CGL comprises a phthalocyanine-based charge generating material and a binder resin, and a weight ratio of the charge generating material to the binder resin is in a range of about 1:0.3 to about 1:4.

3. The laminate type electrophotographic photoreceptor of claim 1, wherein the CTL comprises a charge transporting material and a binder resin, and a weight ratio of the charge transporting material to the binder resin is in a range of about 1:0.5 to about 1:2.

4. The laminate type electrophotographic photoreceptor of claim 1, wherein the UL is a layer in which metal oxide particles are dispersed in a binder resin or is a metal oxide film.

5. The laminate type electrophotographic photoreceptor of claim 1, wherein the photoreceptor is charged by a direct charging method.

6. An electrophotographic image forming apparatus comprising:

an electrophotographic photoreceptor;

a charging device charging the electrophotographic photoreceptor in contact with the electrophotographic photoreceptor;

an exposure device forming an electrostatic latent image on a surface of the electrophotographic photoreceptor;

a developing device developing the electrostatic latent image to form a visible image;

a transferring device transferring the visible image on an image receiving member; and a cleaning device cleaning the surface of the electrophotographic photoreceptor after the transferring, wherein the electrophotographic photoreceptor comprises an electrically conductive substrate; and an undercoat layer (UL), a charge generation layer (CGL), and a charge transport layer (CTL) sequentially disposed on the electrically conductive substrate, wherein a characteristic response time of the photoreceptor is about 10 msec or more and about 85 msec or less and a thickness of the charge transport layer is equal to or greater than about 21 μm and equal to or less than about 45 μm:

wherein the characteristic response time is denoted as a shortest response time in a range of response times generating characteristic photoinduced discharge curves (PIDC), the response time is denoted as a time elapsed from the moment of light exposure of the laminate type electrophotographic photoreceptor to the moment of development thereof, and the characteristic PIDC is denoted, in a photoinduced discharge characteristic test in which the laminate type electrophotographic photoreceptor is charged to have an initial surface potential range of about −500 V to about −700 V by using a direct current (DC) contact charging method in an environment of a temperature of 23° C. and a relative humidity of 50% and, thereafter, the laminate type electrophotographic photoreceptor is exposed to monochromatic light having a wavelength of about 780 nm, as a PIDC exhibiting a saturation phenomenon in which the surface potential of the laminate type electrophotographic photoreceptor after the light exposure is in a range of about 0 V to about −200 V and the surface potential of the laminate type electrophotographic photoreceptor after the light exposure does not change about ±10 V or more even when exposure energy increases 10 times.

7. The electrophotographic image forming apparatus of claim 6, wherein the CGL comprises a phthalocyanine-based charge generating material and a binder resin, and a weight ratio of the charge generating material to the binder resin is in a range of about 1:0.3 to about 1:4.

8. The electrophotographic image forming apparatus of claim 6, wherein the CTL comprises a charge transporting material and a binder resin, and a weight ratio of the charge transporting material to the binder resin is in a range of about 1:0.5 to about 1:2.

9. The electrophotographic image forming apparatus of claim 6, wherein the UL is a layer in which metal oxide particles are dispersed in a binder resin or is a metal oxide film.

10. The electrophotographic image forming apparatus of claim 6, wherein the charging device applies a direct voltage to the electrophotographic photoreceptor.

11. The electrophotographic image forming apparatus of claim 10, wherein the charging device is a charging roller.

12. An electrophotographic cartridge integrally supporting an electrophotographic photoreceptor comprising:

at least one device selected from the group consisting of a charging device charging the electrophotographic photoreceptor in contact with the electrophotographic photoreceptor, a developing device developing an electrostatic latent image formed on the electrophotographic photoreceptor to form a visible image, a transferring device transferring the visible image on an image receiving member and a cleaning device cleaning a surface of the electrophotographic photoreceptor after transferring, and attachable to an electrophotographic image forming apparatus and detachable from the electrophotographic image forming apparatus, wherein the electrophotographic photoreceptor comprises an electrically conductive substrate; and an undercoat layer (UL), a charge generation layer (CGL), and a charge transport layer (CTL) sequentially disposed on the electrically conductive substrate, wherein a characteristic response time of the photoreceptor is about 10 msec or more and about 85 msec or less and a thickness of the charge transport layer is equal to or greater than about 21 μm and equal to or less than about 45 μm:

wherein the characteristic response time is denoted as a shortest response time in a range of response times generating characteristic photoinduced discharge curves (PIDC), the response time is denoted as a time elapsed from the moment of light exposure of the laminate type electrophotographic photoreceptor to the moment of development thereof, and the characteristic PIDC is denoted, in a photoinduced discharge characteristic test in which the laminate type electrophotographic photoreceptor is charged to have an initial surface potential range of about −500 V to about −700 V by using a direct current (DC) contact charging method in an environment of a temperature of 23° C. and a relative humidity of 50% and, thereafter, the laminate type electrophotographic photoreceptor is exposed to monochromatic light having a wavelength of about 780 nm, as a PIDC exhibiting a saturation phenomenon in which the surface potential of the laminate type electrophotographic photoreceptor after the light exposure is in a range of about 0 V to about −200 V and the surface potential of the laminate type electrophotographic photoreceptor after the light exposure does not change about ±10 V or more even when exposure energy increases 10 times.

13. The electrophotographic cartridge of claim 12, wherein the CGL comprises a phthalocyanine-based charge generating material and a binder resin, and a weight ratio of the charge generating material to the binder resin is in a range of about 1:0.3 to about 1:4.

14. The electrophotographic cartridge of claim 12, wherein the CTL comprises a charge transporting material and a binder resin, and a weight ratio of the charge transporting material to the binder resin is in a range of about 1:0.5 to about 1:2.

15. The electrophotographic cartridge of claim 12, wherein the UL is a layer in which metal oxide particles are dispersed in a binder resin or is a metal oxide film.

16. The electrophotographic cartridge of claim 12, wherein the charging device applies a direct voltage to the electrophotographic photoreceptor.

17. The electrophotographic cartridge of claim 16, wherein the charging device is a charging roller.

* * * * *

UNITED STATES PATENT AND TRADEMARK OFFICE

CERTIFICATE OF CORRECTION

PATENT NO. : 8,778,579 B2
APPLICATION NO. : 13/589464
DATED : July 15, 2014
INVENTOR(S) : Ji-uk Kim It is certified that error appears in the above-identified patent and that said Letters Patent is hereby corrected as shown below:

On the Title Page, Item (54), Line 9 and in the Specification, Column 1, Line 9, (Title), Delete "PHOTO RECEPTOR" and insert -- PHOTORECEPTOR --, therefor.

Signed and Sealed this
Fourth Day of November, 2014

Michelle K. Lee

Michelle K. Lee
*Deputy Director of the United States Patent and Trademark Office*